United States Patent [19]

Lindblad et al.

[11] Patent Number: 4,870,465

[45] Date of Patent: Sep. 26, 1989

[54] TONER REMOVAL AND SURFACE ABRADING APPARATUS FOR A CHARGE RETENTIVE SURFACE

[75] Inventors: Nero R. Lindblad, Ontario, N.Y.; Morton Silverberg, Westport, Conn.

[73] Assignee: Xerox Corporation, Stamford, Conn.

[21] Appl. No.: 160,434

[22] Filed: Feb. 25, 1988

[51] Int. Cl.[4] ..... G03G 21/00

[52] U.S. Cl. ..... 355/296; 355/297; 355/298

[58] Field of Search ..... 355/15, 210, 296–299, 355/301; 118/652; 430/125

[56] References Cited

U.S. PATENT DOCUMENTS

| | | | |
|---|---|---|---|
| 4,054,381 | 10/1977 | Bernhard | 355/15 |
| 4,181,425 | 1/1980 | Higaya et al. | 355/15 |
| 4,213,794 | 7/1980 | Wooding et al. | 134/6 |
| 4,329,044 | 5/1982 | Kitajima et al. | 355/15 |
| 4,426,151 | 1/1984 | Agaro et al. | 355/15 |
| 4,427,289 | 1/1984 | Oda | 355/15 |
| 4,442,789 | 4/1984 | Pirwitz | 118/653 |
| 4,593,997 | 6/1986 | Fox et al. | 355/15 |
| 4,648,705 | 3/1987 | Tachibana et al. | 355/15 |

FOREIGN PATENT DOCUMENTS

| | | | |
|---|---|---|---|
| 57-176083 | 10/1982 | Japan | 355/15 |
| 59-178473 | 10/1984 | Japan | 355/15 |
| 60-119591 | 6/1985 | Japan | 355/15 |
| 61-77882 | 4/1986 | Japan . | |

OTHER PUBLICATIONS

Xerox Disclosure Journal; Snelling; "Foam Pump Cleaner"; vol. 5; No. 6; Nov./Dec.; 1980, pp. 637–638.

Xerox Disclosure Journal; Bean; "Cleaning of a Xerographic Plate with Helical Cleaning Elements"; vol. 1, No. 8, Aug. 1976; p. 67.

"Cleaning Device for Electrophotographic Copying Machine", Koukai Gihoh, Jan. 20, 1988.

*Primary Examiner*—Arthur T. Grimley
*Assistant Examiner*—J. Pendegrass
*Attorney, Agent, or Firm*—Mark Costello

[57] ABSTRACT

In association with a blade cleaning arrangement supported for chiseling removal of toner from a charge retentive surface, an auger is provided to move toner to the edge of the charge retentive surface and simultaneously simulate a foam roll cleaner, known to have good abrasive characteristics in the presence of toner. An auger member having a roughened or sharpened surface in contact with a charge retentive surface is arranged slightly upstream and adjacent to a blade cleaning arrangement for the removal of residual toner accumulating adjacent to a cleaning blade after release from a charge retentive surface such as a photoreceptor in a reproduction machine. The auger member may be comprised of a foam material providing an abrading surface roughness. Other augering members simulate the abrading qualities of the foam roll cleaner, such as for example, a sharpened auger edge which lightly scrapes the charge retentive surface, or an auger of a polymeric material, with a roughed surface.

8 Claims, 2 Drawing Sheets

TONER REMOVAL AND SURFACE ABRADING APPARATUS FOR A CHARGE RETENTIVE SURFACE

This invention relates to reproduction apparatus and more particularly to cleaning apparatus for removing residual toner from a charge retentive surface, and abrading that surface to remove film not removed by standard cleaning arrangements.

INCORPORATION BY REFERENCE

The following are incorporated by reference for the purpose of background information: 4,648,705 to Tachibana et al.; US-A 4,593,997 to Fox et al.; US-A 4,427,289 to Oda; JP 61-77882 (A) To Saito; US-A 4,329,044 to Kitajima et al.; US-A 4,213,794 to Woodling et al.; US-A 4,054,381 to Bernhard; and US-A 4,442,789 to Pirwitz; and, Snelling, Xerox Disclosure Journal Volume 5, No. 6, Nov./Dec. 1980, pp. 637, 638.

BACKGROUND OF THE INVENTION

In electrophotographic applications such as xerography, a charge retentive surface is electrostatically charged, and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development, excess toner left on the charge retentive surface is cleaned from the surface. The process is well known, and useful for light lens copying from an original, and printing applications from electronically generated or stored originals, where a charged surface may be imagewise discharged in a variety of ways.

Although a preponderance of the toner forming the image is transferred to the substrate during transfer, some toner invariably remains on the charge retentive surface, being held thereto by relatively high electrostatic and/or mechanical forces. It is essential for potimum operation that toner and debris remaining on the surface be cleaned thoroughly therefrom. In addition to such toner and debris, a film build up is noted of material not removed by standard cleaning techniques.

Blade cleaning is a highly desirable method for removal of residual toner from a charge retentive surface. In such an arrangement, a cleaning blade is provided and supported adjacent the charge retentive surface with a blade edge chiseling toner from contact with the surface. Subsequent to removal from the surface, toner is transported away from the blade area by a toner transport arrangement. Blade cleaning arrangements are very effective, inexpensive relative to other cleaning devices, and very serviceable over the device lifetime. Variations in lubricants and materials allow the use of blade cleaning at relatively high speed. Compared to brush cleaners, cleaning blades are less expensive and do not create the tirboelectric problems associated with brush cleaners handling electrostatically attractable powders.

Removal of accumulating toner from the blade area may be accomplished in a variety of ways, each dependent on the machine arrangement. While a cleaning arrangement for a cylinder or a vertical surface may allow toner to simply fall from the blade area to a toner transport device such as an auger, as shown for example in 4,648,705 to Tachibana et al., or US-A 4,593,997 to Fox et al., positioning the cleaning arrangement on a horizontal upwardly facing surface, sometimes referred to as twelve o'clock cleaning, requires removal of toner from the surface. Typically, toner might be removed from the blade area either by a brush arrangement which transports the toner to an auger arrangement for transport to another area, such as shown for example in US-A 4,427,289 to Oda and JP 61-77882 (A) to Saito or directly by an augering arrangement, such as shown for example in US-A 4,329,044 to Kitajima et al. Either arrangement serves to transport toner removed from the charge retentive area satisfactorily. Generally the auger edge in contact with the charge retentive surface is smooth to avoid damage to surfaces. Brush augering arrangements are known for removal of toner from fiber brush cleaners, as shown in US-A 4,213,794 to Woodling et al. and for carrying toner along toner transport paths as shown in US-A 4,054,381 to Bernhard and US-A 4,442,789 to Pirwitz.

Over periods of time, despite the cleaning action of the blade a buildup of residue or toner film on the charge retentive surface may be noted, manifesting itself as comets, spots, and other copy quality defects, on copies made in the device. This film may be removed from the surface with a slight abrading action. Of course, it will no doubt be appreciated that the abrasion must not be so rough as to damage the charge retentive surface, but must be adequate to remove the buildup of toner film. It has been noted that a foam roll may be constructed adequately in this regard. In operation, foam cleaning rolls have a tendency to collect toner in open pores in the foam. The toner seated in the pores abrades the charge retentive surface as it comes into contact therewith, effectively scraping the buildup of contaminants from the charge retentive surface.

Snelling, Xerox Disclosure Journal, Volume 5, No. 6, November/ December 1980, pp. 637, 638, shows an auger-shaped member which simultaneously cleans and carries toner from a charge retentive surface with a pumping action created by its rotation within a closed container. However, it does not appear to suggest use of advantageous blade cleaning methods which sealingly prevent toner from passing through the cleaning station, suggest that abrasion of the charge retentive surface is desirable, nor suggest that foam material used should be provided with toner collecting pores for abrasion of the charge retentive surface. Foam roll cleaning devices used alone suffer from difficulties in cleaning toner from the foam roll. Additionally, the high speed believed required by the device to create an air pumping action, and satisfactorily clean the surface of the charge retentive surface would be higher than desirable to avoid wear on the charge retentive surface. Bean, Xerox Disclosure Journal, Volume 1, No. 8, August 1976, page 67, demonstrates a foam rubber helical cleaning member, also deficient in these aspects.

SUMMARY OF THE INVENTION

In accordance with the invention there is provided an improved cleaning arrangement for removal of toner and debris from a charge retentive surface of photoreceptor surface, which simultaneously transports toner away from the area adjacent to a toner removal device and abrades the charge retentive surface for the removal of toner film. Mechanical abrasion of the film or buildup on the photoreceptor improves the overall performance of the machine. Additionally, the use of mechanical film removal techniques eliminates any need for abrasive additives to toner.

In accordance with one aspect of the invention, in association with a blade cleaning arrangement supported for chiseling removal of toner from a charge retentive surface, an auger member is provided to move toner to the edge of the charge retentive surface and simultaneously simulate a foam roll cleaner, known to have good abrasive characteristics in the presence of toner. An auger member having a roughened or sharpened surface is arranged slightly upstream and adjacent to a blade cleaning arrangement for the removal of residual toner accumulating adjacent to a cleaning blade after release from a charge retentive surface such as a photoreceptor in a reproduction machine. The auger member may be comprised of a foam material having a large number of open pores to collect toner and provide an abrading surface roughness. The foam spiral auger member is provided with a flat surface portion in contact with the photoreceptor for abrading the charge retentive surface for the removal of toner film. The augering motion of the foam auger member serves to simultaneously move toner and abrade the charge retentive surface. Other augering arrangements are also within the scope of the invention which simulate the abrading qualities of the foam roll cleaner, such as for example, a sharpened auger edge which lightly scrapes the charge retentive surface, or an auger of a polymeric material, roughed to simulate the toner collecting pores of a foam roll member.

The abrading action of the auger also aids in removal of paper fibers and other impurities from the photoreceptor. By properly designing the auger and selecting an appropriate speed of rotation, the probability of paper fibers slipping by the augur can be minimized. The rate of toner removal from the toner pile in front of the blade must be fast compared to the time for incoming debris to reach the blade cleaning edge. Keeping loose debris from reaching the cleaning edge will have a significant effect on cleaning reliability.

These and other aspect of the invention will become apparent from the following description used to illustrate a preferred embodiment of the invention read in conjunction with the accompanying drawings in which.

Figure 1:
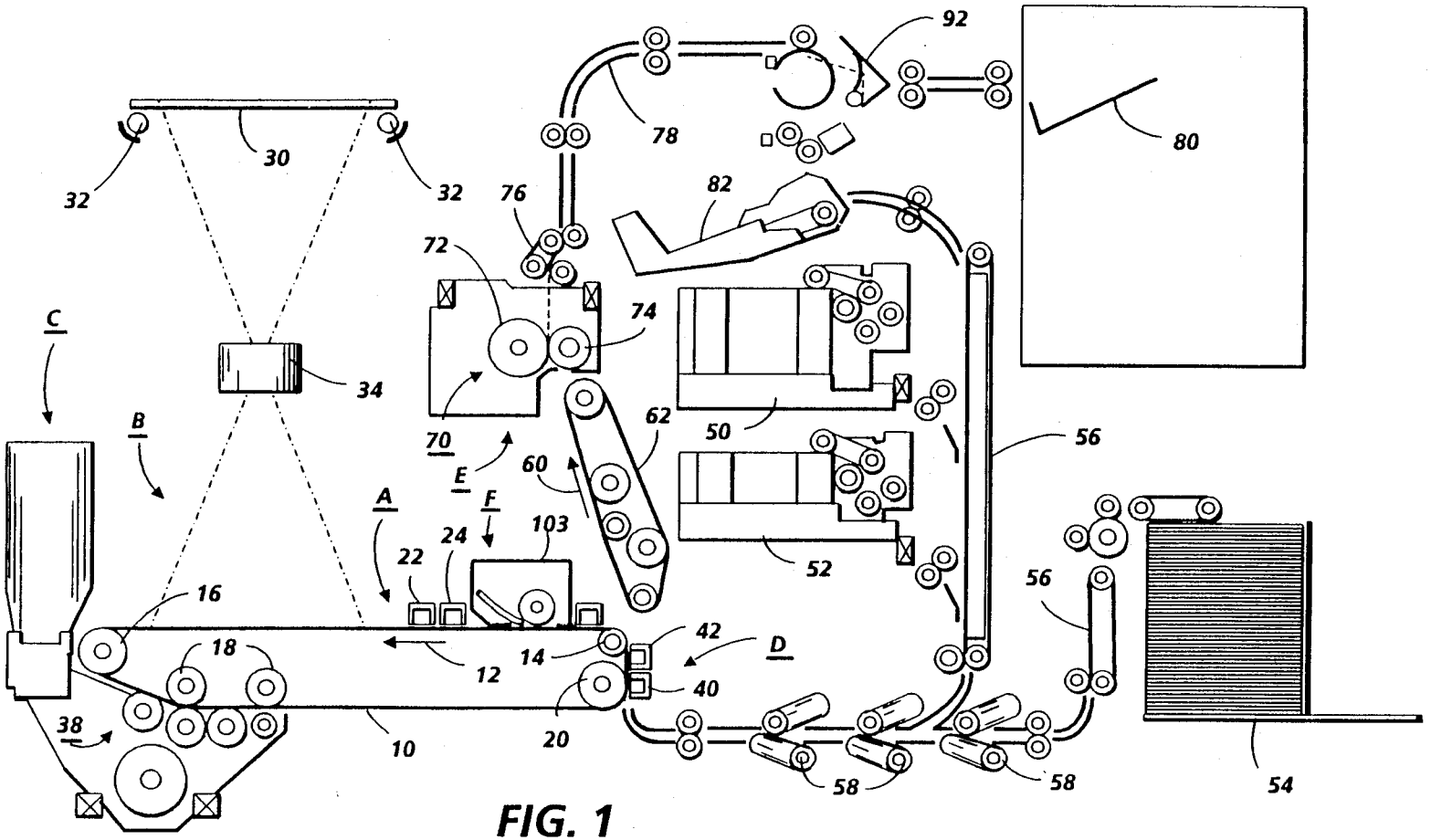
FIG. 1 is a schematic elevational view depicting an electrophotographic printing machine incorporating the present invention.

Referring now to the drawings, where the showings are for the purpose of describing a preferred embodiment of the invention and not for limiting same, the various processing stations employed in the reproduction machine illustrated in FIG. 1 will be described only briefly. It will no doubt be appreciated that the various processing elements also find advantageous use in electrophotographic printing applications from an electronically stored original.

A reproduction machine in which the present invention finds advantageous use utilizes a photoreceptor belt 10. Belt 10 moves in the direction of arrow 12 to advance successive portions of the belt sequentially through the various processing stations disposed about the path of movement thereof.

Belt 10 is entrained about stripping roller 14, tension roller 16, idler rollers 18, and drive roller 20. Drive roller 20 is coupled to a motor (not shown) by suitable means such as a belt drive.

Belt 10 is maintained in tension by a pair of springs (not shown) resiliently urging tension roller 16 against belt 10 with the desired spring force. Both stripping roller 18 and tension roller 16 are rotatably mounted. These rollers are idlers which rotate freely as belt 10 moves in the direction of arrow 16.

With continued reference to FIG. 1, initially a portion of belt 10 passes through charging station A. At charging station A, a pair of corona devices 22 and 24 charge photoreceptor belt 10 to a relatively high, substantially uniform negative potential.

At exposure station B, an original document is positioned face down on a transparent platen 30 for illumination with flash lamps 32. Light rays reflected from the original document are reflected through a lens 34 and projected onto a charged portion of photoreceptor belt 10 to selectively dissipate the charge thereon. This records an electrostatic latent image on the belt which corresponds to the informational area contained within the original document.

Thereafter, belt 10 advances the electrostatic latent image to development station C. At development station C, a magnetic brush developer unit 38 advances a developer mix (i.e. toner and carrier granules) into contact with the electrostatic latent image. The latent image attracts the toner particles from the carrier granules thereby forming toner powder images on photoreceptor belt 10.

Belt 10 then advances the developed latent image to transfer station D. At transfer station D, a sheet of support material such as paper copy sheet is moved into contact with the developed latent images on belt 10. First, the latent image on belt 10 is exposed to a pretransfer light from a lamp (not shown) to reduce the attraction between photoreceptor belt 10 and the toner powder image thereon. Next corona generating device 40 charges the copy sheet to the proper potential so that it is tacked to photoreceptor belt 10 and the toner powder image is attracted from photoreceptor belt 10 to the sheet. After transfer, a corona generator 48 charges the copy sheet to an opposite polarity to detack the copy sheet for belt 10, whereupon the sheet is stripped from belt 10 at stripping roller 14.

Sheets of support material are advanced to transfer station D from supply trays 50, 52 and 54, which may hold different quantities, sizes and types of support materials. Sheets are advanced to transfer station D along conveyor 56 and rollers 58. After transfer, the sheet continues to move in the direction of arrow 60 onto a conveyor 62 which advances the sheet to fusing station E.

Fusing station E includes a fuser assembly, indicated generally by the reference numeral 70, which permanently affixes the transferred toner powder images to the sheets. Preferably, fuser assembly 70 includes a heated fuser roller 72 adapted to be pressure engaged with a back-up roller 74 with the toner powder images contacting fuser roller 72, In this manner, the toner powder image is permanently affixed to the sheet.

After fusing, copy sheets bearing fused images are directed through decurler 76. Chute 78 guides the advancing sheet from decurler 76 to catch tray 80 or a finishing station for binding, stapling, collating etc. and removal from the machine by the operator. Alternatively, the sheet may be advanced to a duplex tray 90 from duplex gate 92 from which it will be returned to the processor and conveyor 56 for receiving second side copy.

A pre-clean corona generating device 94 is provided for exposing the residual toner and contaminants to positive charges to thereby narrow the charge distribution thereon for more effective removal at cleaning station F, more completely described hereinafter. It is contemplated that residual toner remaining on photoreceptor belt 10 after transfer will be reclaimed and returned to the developer station C by any of several well known reclaim arrangements, and in accordance with the present invention, described below.

As thus described, a reproduction machine in accordance with the present invention may be any of several well known devices. Variations may be expected in specific processing, paper handling and control arrangements without affecting the present invention.

Figure 2:
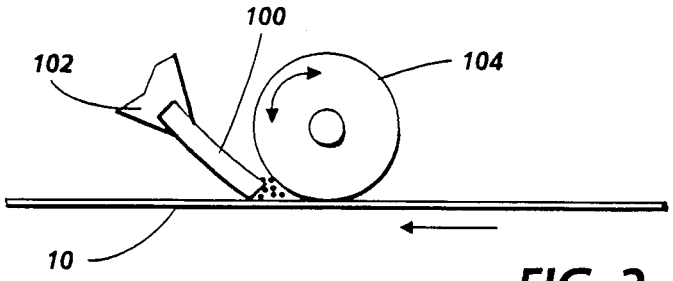
FIG. 2 is a schematic elevational view of a cleaner incorporated in the device of FIG. 1, and including the inventive foam auger member.
Figure 3:
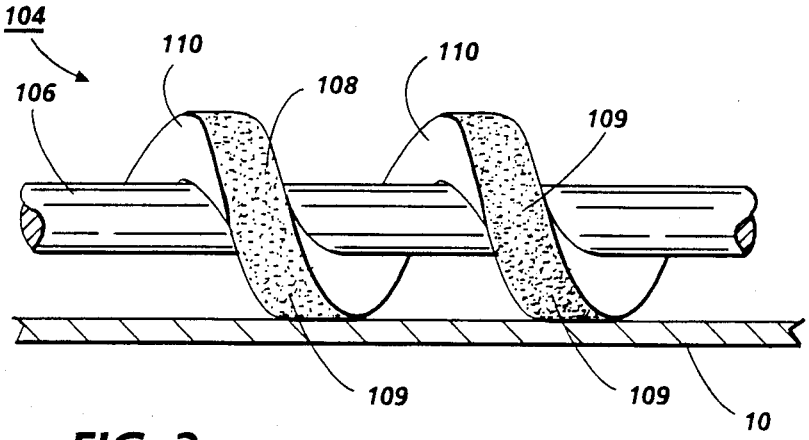
FIG. 3 is a front view of an auger in accordance with the invention.

In accordance with the invention, and with reference to FIGS. 1 and 2, cleaning station F generally includes a cleaning blade 100 supported in blade support 102 for cleaning engagement with photoreceptor belt 10 for the chiseling removal of toner from photoreceptor belt 10 within housing 103. Blade 100 may advantageously be a thin urethane member having a rectangular cross-section, and supported in slightly deforming engagement with the photoreceptor belt 10. Supported slightly upstream and generally parallel to blade 100 across photoreceptor belt 10 is foam auger member 104 arranged for abrading contact with the belt 10. As better shown in FIG. 3, foam auger member 104 is a generally spiral shaped member, including an auger shaft 106 journaled for rotating movement by a motor or drive means (not shown). The spiral movement of the auger member as driven by the drive means carries toner along its length to the side edge of the photoreceptor. The foam auger surface 108 in contact with photoreceptor belt 10 is provided with a large number of pores 109 which serve to collect toner for abrasion of the photoreceptor. The rotating motion of the auger serves to carry toner to the edge of the photoreceptor belt 10 to any of several types of toner transport. As the auger rotates, contact between the auger and the photoreceptor provides a slight abrasion desirable for cleaning toner film from the surface of the photorecptor. Advantageously, because of the spiral shape of the auger, the photoreceptor surface is not continuously abraded, as with a foam roll cleaner, thereby reducing the wear on the surface, while still providing satisfactory cleaning operation. While the auger edges 110 are shown to be square, beveled or rounded edges may be desirable depending on the material used and the force with which the auger contacts the photoreceptor belt 10. Foam material choices include polyester urethane and polyether urethane, which have a reticulated open cell structure, between 35-100 pores/linear inch, and low set, high resilience, with HR values of 2, 4 or 6. Other material having these characteristics may also be suitable. While microcellular material having greater than 100 pores/linear inch may also be useful, it is believed that the pores will be too small for collection of toner. Foam felts or compressed foams may also be useful, with firmness values of 2–10, and having about 80 pores/inch. Foam materials, either with abrasive materials such as silica or alumina distributed through the material or with abrasive materials glued to surface 108 of the auger contacting photoreceptor belt 10 may also be suitable for use.

The auger member is rotated to minimize debris such as paper fiber slipping by the member. The rate of toner removal from the toner pile in front of the blade must be fast compared to the time for incoming debris to reach the blade cleaning edge. The reduction of loose debris reaching the cleaning blade will have a significant effect on cleaning efficiency.

Figure 4:
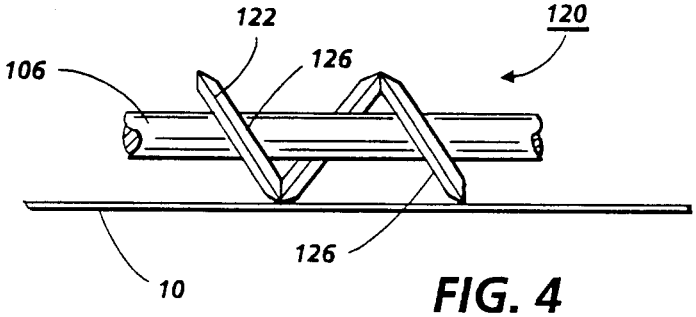
FIGS. 4 and 5 are alternative embodiments of augers in accordance with the invention.

In accordance with another embodiment of the invention, and as shown in FIG. 4, auger 120 may instead be a metal member provided with a relatively sharp edge 122 which scrapes the photoreceptor surface free of toner film. In accordance with this embodiment, the auger is operable in the same fashion to remove toner collecting adjacent to the blade, but is arranged to lightly scrape the surface with the sharp edge 122. While the auger edge 122 is illustrated as a knife edge beveled on both sides 124 and 126 of auger edge 122, various other edges might be provided to achieve similar results, such as for example, a single beveled edge, on the side in the direction of toner movement. Desirably the metal is a non-ferrous material to avoid rusting. The auger edge 122 may be roughed.

Figure 5:
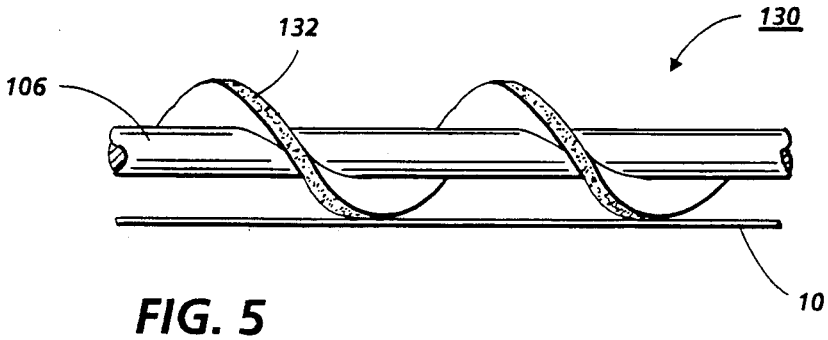

In accordance with yet another embodiment of the invention as shown in FIG. 5, auger 130 may be manufactured from a polymeric or plastic material in which the surface 132 in contact with the photoreceptor may be slightly roughened to provide an abrading contact with photoreceptor belt 10. Polypropylene, polycarbonate, and ultra high molecular weight polyethylene are among the materials suitable for use. The materials may be provided with abrasive filler such as, for example, silica, calcium carbonate, carbides, nitrides, phosphates, glass fibers, or carbon fibers at filler concentrations of about 5–30%. The abrasive material itself may provide a satisfactory roughening of the surface 132.

The invention has been described with reference to a preferred embodiment. Obviously modifications will occur to others upon reading and understanding the specification taken together with the drawings. This embodiment is but one example, and various alternatives modifications, variations or improvements may be made by those skilled in the art from this teaching which are intended to be encompassed by the following claims.

We claim:

1. Reproduction apparatus including a charge retentive surface; image forming means for forming a latent image on the charge retentive surface; means for developing the latent image with toner; transfer means for transferring the developed toner image from the charge retentive surface to a support surface; and cleaning means for removing residual toner from the charge retentive surface, said cleaning means comprising:

a cleaning blade supported within a cleaning housing for chiseling removal of toner from the charge retentive surface and accumulating removed toner adjacent thereto;

toner removal means for removal of toner from the area adjacent to the cleaning blade, including a spiral shaped auger member journaled for rotating movement to carry toner from the cleaning blade to an output, and having an auger member surface contacting and abrading the charge retentive surface whereby strongly adhering spots of film of foreign material remaining on surface subsequent to cleaning are removed, and wherein the auger member is rotated so that the rate of accumulated toner removal from the area adjacent the cleaning blade is fast when compared to the time for toner to reach the cleaning blade.

2. The apparatus as defined in claim 1 wherein the spiral auger member is comprised of a foam material.

3. The apparatus as defined in claim 2 wherein the auger member surface includes a plurality of pores collecting toner and abrading the charge retentive surface therewith.

4. The apparatus as defined in claim 2 wherein the foam material is filled with an abrasive material.

5. The apparatus as defined in claim 2 wherein the spiral auger member is provided with an abrasive material at the auger member surface contacting and abrading the charge retentive surface.

6. The apparatus as defined in claim 1 wherein the spiral auger member is comprised of a polymeric material, with a roughened auger member surface.

7. The apparatus as defined in claim 1 wherein the spiral auger member is comprised of a polymeric material, filled with an abrasive material.

8. Reproduction apparatus including a charge retentive surface; image forming means for forming a latent image on the charge retentive surface; means for developing the latent image with toner; transfer means for transferring the developed toner image from the charge retentive surface to a support surface; and cleaning means for removing residual toner from the charge retentive surface, said cleaning means comprising:

a cleaning blade supported within a cleaning housing for chiseling removal of toner from the charge retentive surface and accumulating removed toner adjacent thereto;

toner removal means for removal of toner from the area adjacent to the cleaning blade, including a spiral shaped auger member journaled for rotating movement to carry toner from the cleaning blade to an output, and having a beveled auger member edge contacting and abrading the charge retentive surface whereby strongly adhering spots of film of foreign material remaining on surface subsequent to cleaning are removed.

* * * * *